US007615136B2

(12) United States Patent
Silva

(10) Patent No.: US 7,615,136 B2
(45) Date of Patent: Nov. 10, 2009

(54) MACHINE FOR THE MANUFACTURE OF A FIBER MATERIAL WEB

(75) Inventor: Luiz Silva, Campo Limpo Paulista (BR)

(73) Assignee: Voith Patent GmbH, Heidenheim (DE)

( * ) Notice: Subject to any disclaimer, the term of this patent is extended or adjusted under 35 U.S.C. 154(b) by 372 days.

(21) Appl. No.: 10/573,110

(22) PCT Filed: Sep. 17, 2004

(86) PCT No.: PCT/EP2004/052224

§ 371 (c)(1),
(2), (4) Date: Dec. 7, 2006

(87) PCT Pub. No.: WO2005/031065

PCT Pub. Date: Apr. 7, 2005

(65) Prior Publication Data

US 2007/0068645 A1 Mar. 29, 2007

(30) Foreign Application Priority Data

Sep. 26, 2003 (EP) ..... 03021859

(51) Int. Cl.

| | |
|---|---|
| ***D21F 3/00*** | (2006.01) |
| ***D21F 9/00*** | (2006.01) |
| ***D21F 1/48*** | (2006.01) |
| ***D21F 5/02*** | (2006.01) |

(52) U.S. Cl. ..... 162/358.1; 162/297; 162/301; 162/305; 162/313; 162/364; 162/359.1

(58) Field of Classification Search ..... 162/358.1, 162/358.3, 204–207, 363, 364, 367, 368, 162/375, 358.5, 359.1, 297, 300, 301, 305, 162/308, 312–314, 203; 34/444, 452, 453, 34/458, 111, 123, 629, 635; 100/153, 37, 100/151

See application file for complete search history.

(56) References Cited

U.S. PATENT DOCUMENTS

| | | | | |
|---|---|---|---|---|
| 4,139,410 | A | 2/1979 | Tapio et al. | |
| 4,144,124 | A * | 3/1979 | Turunen et al. | 162/290 |
| 6,004,429 | A * | 12/1999 | Schiel | 162/111 |
| 6,334,932 | B1 | 1/2002 | Meschenmoser | |
| 6,340,413 | B1 | 1/2002 | Nilsson et al. | |
| 2003/0136018 | A1 * | 7/2003 | Herman et al. | 34/114 |

FOREIGN PATENT DOCUMENTS

| | | | |
|---|---|---|---|
| DE | 17 61 505 | B | 7/1971 |
| WO | WO 9940255 | A | 8/1999 |

OTHER PUBLICATIONS

International Search Report for PCT/EP2004/052224.
Written Opinion of the International Searching Authority for PCT/EP2004/052224.

* cited by examiner

*Primary Examiner*—Eric Hug
(74) *Attorney, Agent, or Firm*—Taylor & Aust, P.C.

(57) ABSTRACT

A machine for the manufacture of a fiber material web (12), in particular a paper or card web, having a forming zone including at least one circulating endless dewatering belt (16, 18) includes at least one pressing zone (14) combined with a suction system.

36 Claims, 7 Drawing Sheets

MACHINE FOR THE MANUFACTURE OF A FIBER MATERIAL WEB

Figure 1:
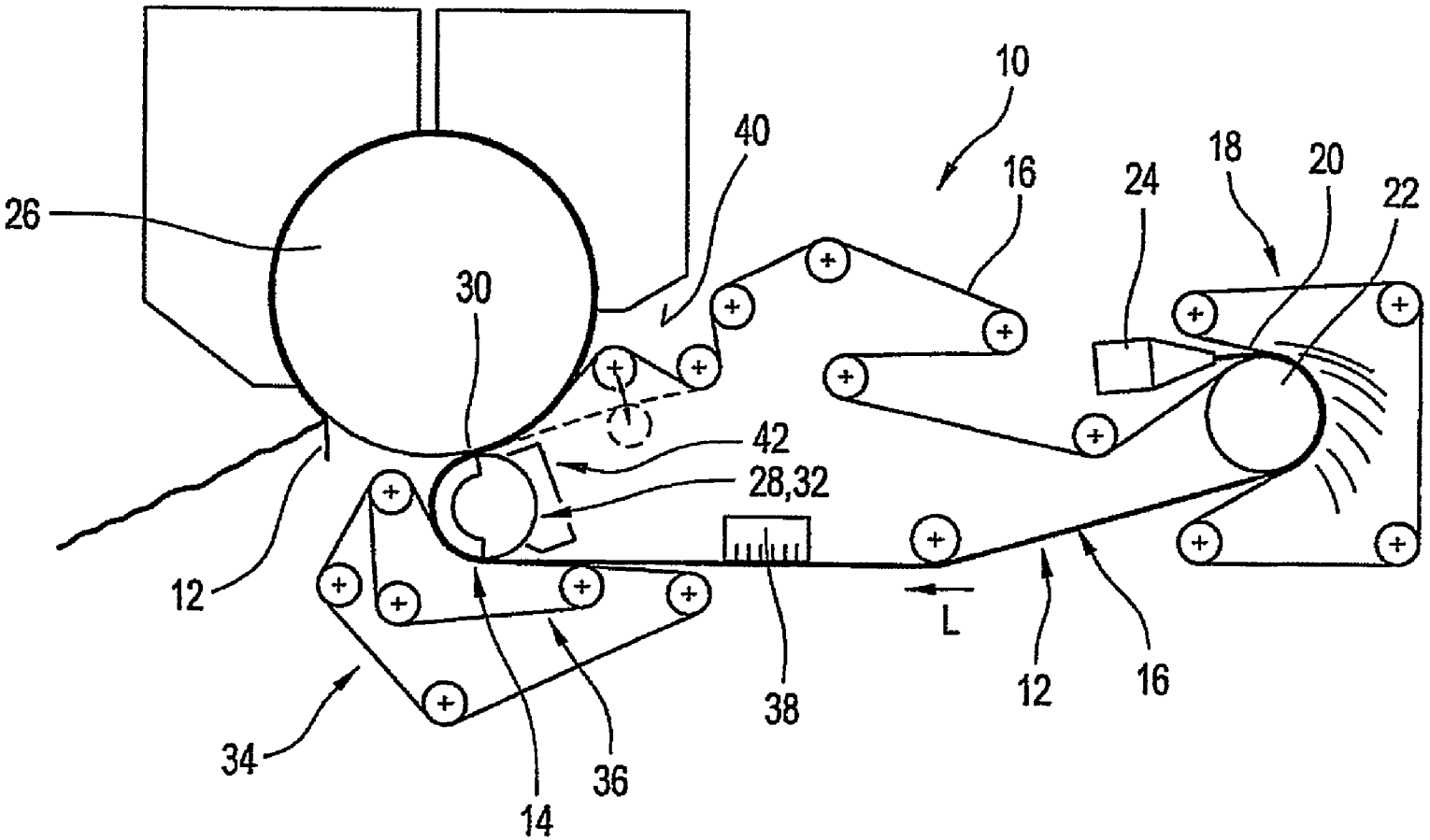

The invention relates to a machine for the manufacture of a material web, in particular a paper or card web, having a forming zone including at least one circulating, endless, dewatering belt.

The invention is based on the object of further optimizing the machine of the initially named kind, in particular with respect to the dry content and/or paper quality obtained after the pressing.

This object is satisfied in accordance with the invention in that the machine includes at least one pressing zone combined with a suction system.

As a result of this design an additional gain in dry content and/or paper quality is achieved after the pressing.

In a preferred practical embodiment the machine includes a former with two circulating dewatering belts which converge while forming a material web gap and which are subsequently guided as an inner belt and an outer belt respectively over a forming element, such as in particular a forming roll.

The pressing zone combined with a suction system is expediently provided in the web running direction in front of a nip formed between a dryer cylinder, preferably a Yankee cylinder, and a counter element.

For the formation of the pressing zone combined with a suction system an element to which suction can be applied is preferably provided. In this arrangement this element to which suction can be applied can, for example, include a suction roll or the like.

In a preferred practical embodiment of the machine of the invention the fiber material web is led together with the inner belt to the pressing zone.

A further dewatering belt can be guided around the element to which suction can be applied in addition to the inner belt which is supported on the latter, with the fiber material web lying between the inner belt and the further dewatering belt.

In accordance with an expedient practical embodiment a belt arranged within the loop of the further dewatering belt is tensioned around the element to which suction can be applied.

The further dewatering belt which is led around the element to which suction can be applied can be formed by a conventional, in particular non-structured screen or by a structured screen.

In an advantageous practical embodiment the further dewatering element which is led around the element to which suction can be applied is formed by a TAD screen (TAD=Through-Air-Drying).

In addition, the further dewatering belt which is led around the element to which suction can be applied can in particular also be formed by a dewatering screen with differing screen permeability zone-wise, such as in particular a so-called DSP screen etc.

Screens with differing permeability zone-wise are for example known from SE 427053. In accordance with this, the relevant screens can, for example, consist of a fabric in which longitudinal threads and transverse threads provided in one plane or in a plurality of planes are interwoven in accordance with a pre-determinable pattern, so that systematically distributed zones of suitable size result in which the number of crossing points is equal to zero or are significantly smaller than in the woven structure of the remaining fabric.

Screens of the type which are described in PCT/GB99/02684 can, for example, also be considered as screens having differing permeability zone-wise. In accordance with this, the relevant screen can in particular consist of a fabric in which threads extending in a first direction in one plane or in a plurality of planes are so interwoven with threads extending in the second direction that a grid results which separates a plurality of systematically distributed zones of pre-determinable configuration from one another and correspondingly determines them, with the systematically distributed zones including at least three threads extending in the one direction and at least three threads extending in the other direction. The threads can in particular be weft threads and warp threads.

The tension of the belt tensioned around the element to which suction can be applied and which is arranged within the loop of the further dewatering belt can in particular be larger than or equal to 60 kN/m.

The belt which is tensioned around the element to which suction can be applied and arranged within the loop of the further dewatering belt can have a smooth surface or also a drilled and/or grooved surface or any kind of porosity shape or pattern.

The pressing zone combined with a suction system can form a longitudinal gap or also a normal gap.

In a preferred practical embodiment of the machine in accordance with the invention, the element to which suction can be applied is simultaneously provided as the counter-element which forms the nip together with the dryer cylinder or the Yankee cylinder.

The outer belt can in particular be formed by a dewatering screen.

A crescent former can, for example, be provided as the former, with the outer belt of the crescent former being formed by a dewatering screen and its inner belt by a felt.

The dry content of the fiber material web in front of the pressing zone preferably lies in a range from about 8% to about 15% and after the pressing zone in a range of about 40% or higher.

A suction box can be provided between the forming element and the pressing zone. In this arrangement the dry content of the fiber material web directly after the suction box and before the pressing zone can in particular lie in a range of about 23%.

The fiber material web can be fed to the dryer cylinder or the Yankee cylinder with an open nip or with a closed nip.

In an expedient practical embodiment a guide roll for the inner belt which guides the fiber material web with it, in particular an adjustable and/or movable guide roll, is provided in the web running direction after the nip.

The tension of the further dewatering belt expediently amounts to about 5 kN/m.

The tension of the outer belt amounts to about 8 kN/m.

The tension of the inner belt can, for example, amount to about 5 kN/m.

In accordance with a further expedient practical embodiment of the machine of the invention, a double screen former is provided as the former.

A further element to which suction can be applied can be provided within the loop of the further dewatering belt.

This further element to which suction can be applied is preferably only wrapped around by the further dewatering belt.

The further element to which suction can be applied can, for example, be formed by a suction roll or by a suction box.

In an expedient practical embodiment of the machine of the invention the fiber material web can be supplied to the dryer cylinder or to the Yankee cylinder by closing of the nip.

In a further expedient practical embodiment of the machine of the invention both the inner belt and also the further dewatering belt is respectively formed by a felt.

A further advantageous embodiment of the machine of the invention is characterized in that a roll lies opposite to the element to which suction can be applied within the loop of the further dewatering belt. This roll can have a closed surface or can also be grooved and/or blind-drilled.

The roll provided within the loop of the further dewatering belt can in particular be formed by a rigid roll.

Embodiments in which a shoe pressing unit lies opposite to the element to which suction can be applied within the loop of the further dewatering belt are, however, fundamentally also conceivable. A shoe pressing unit of this kind can, for example, include a shoe pressing roll or the like.

In accordance with a further practical embodiment of the machine of the invention a double screen former is provided as the former and the further dewatering belt is formed by a felt.

Figure 2:
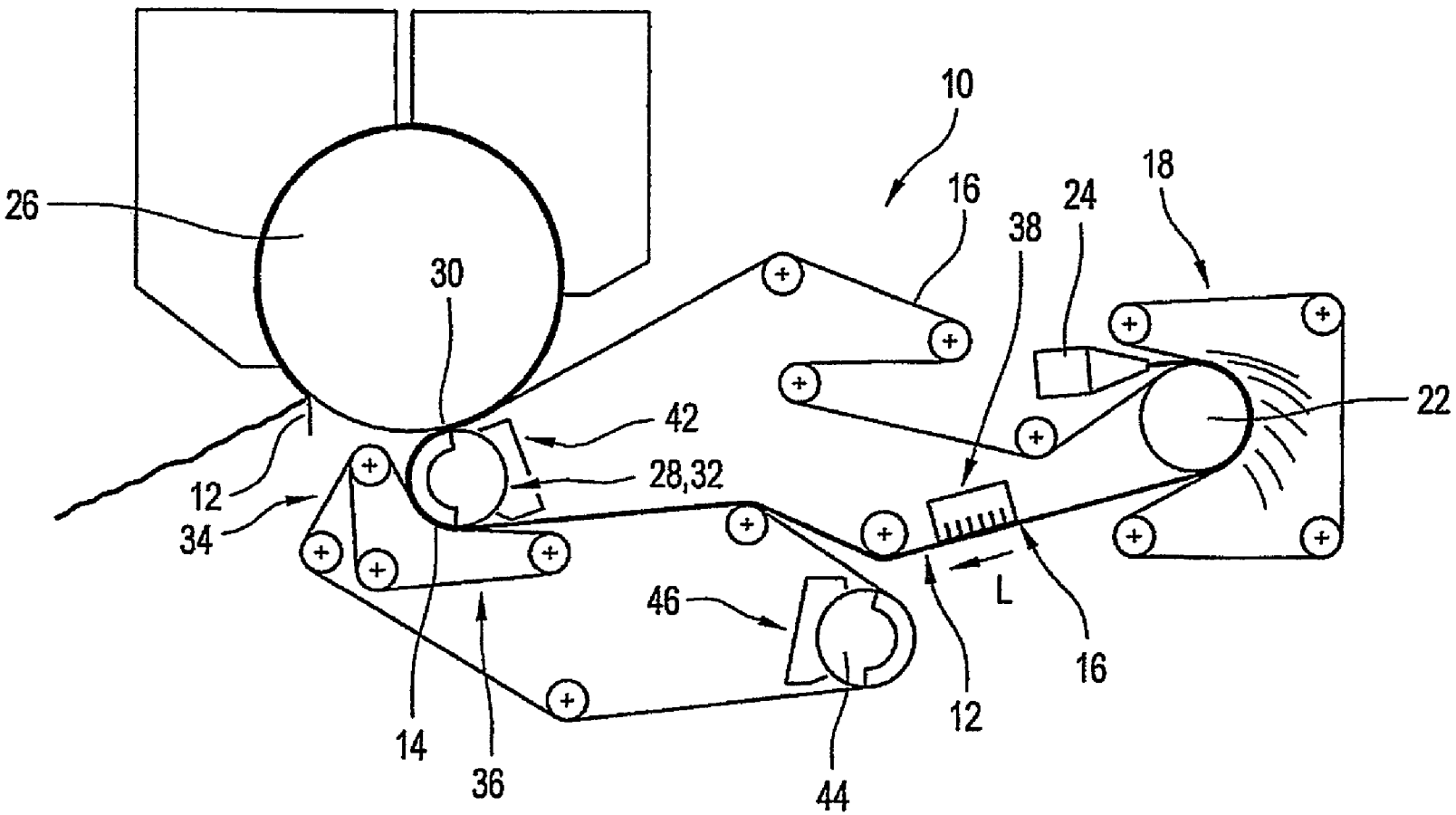
Figure 3:
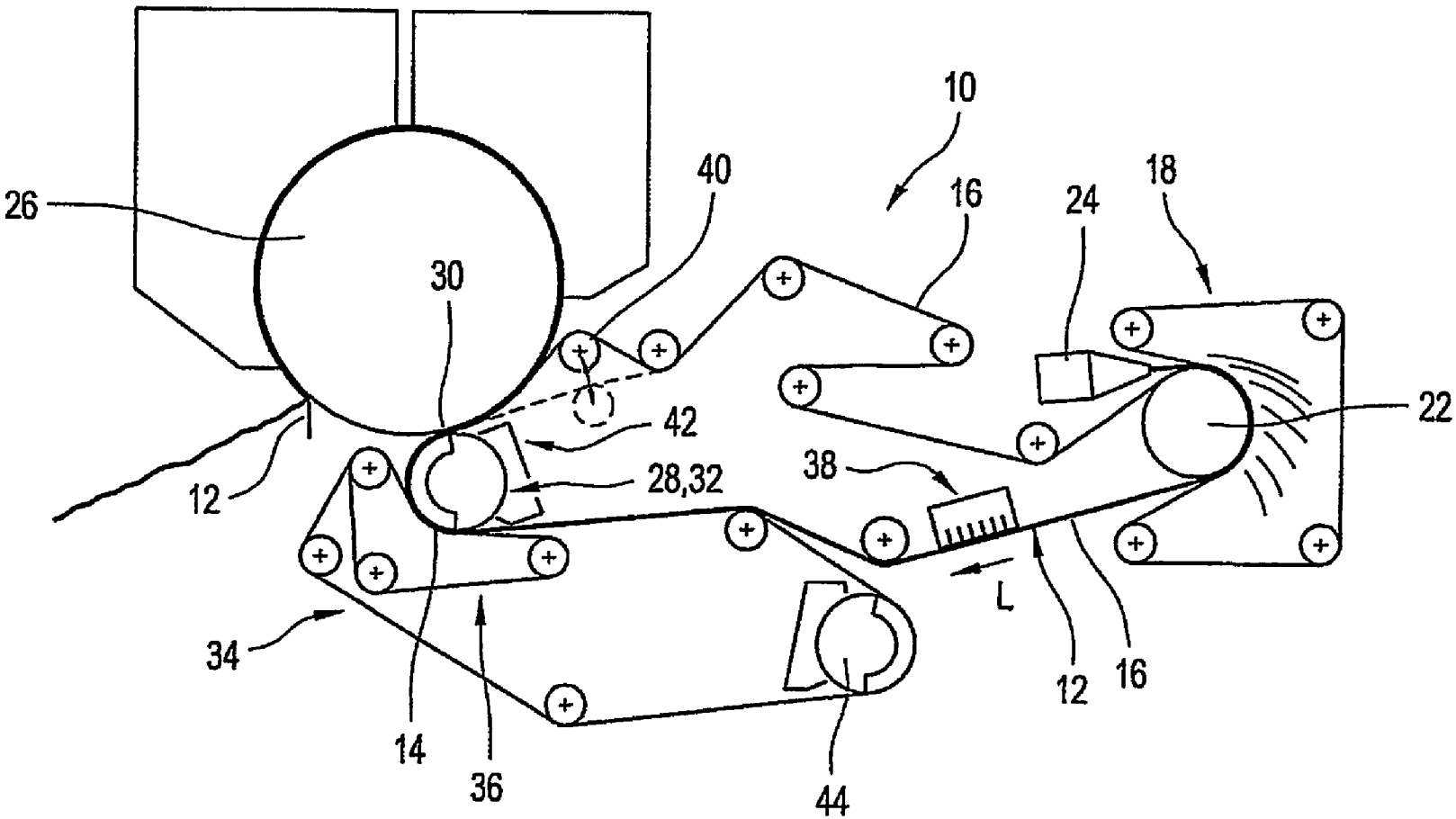
Figure 4:
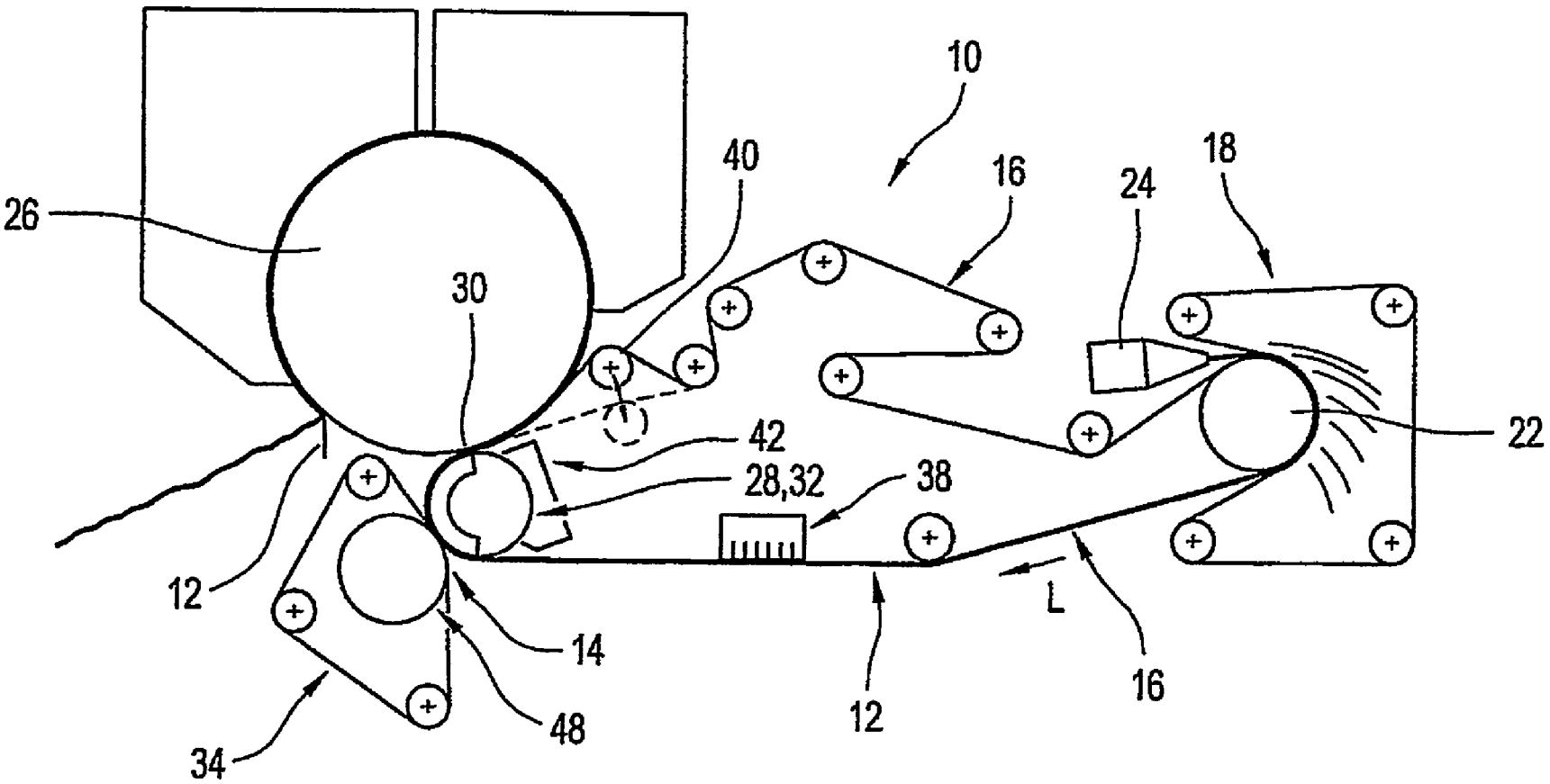
Figure 5:
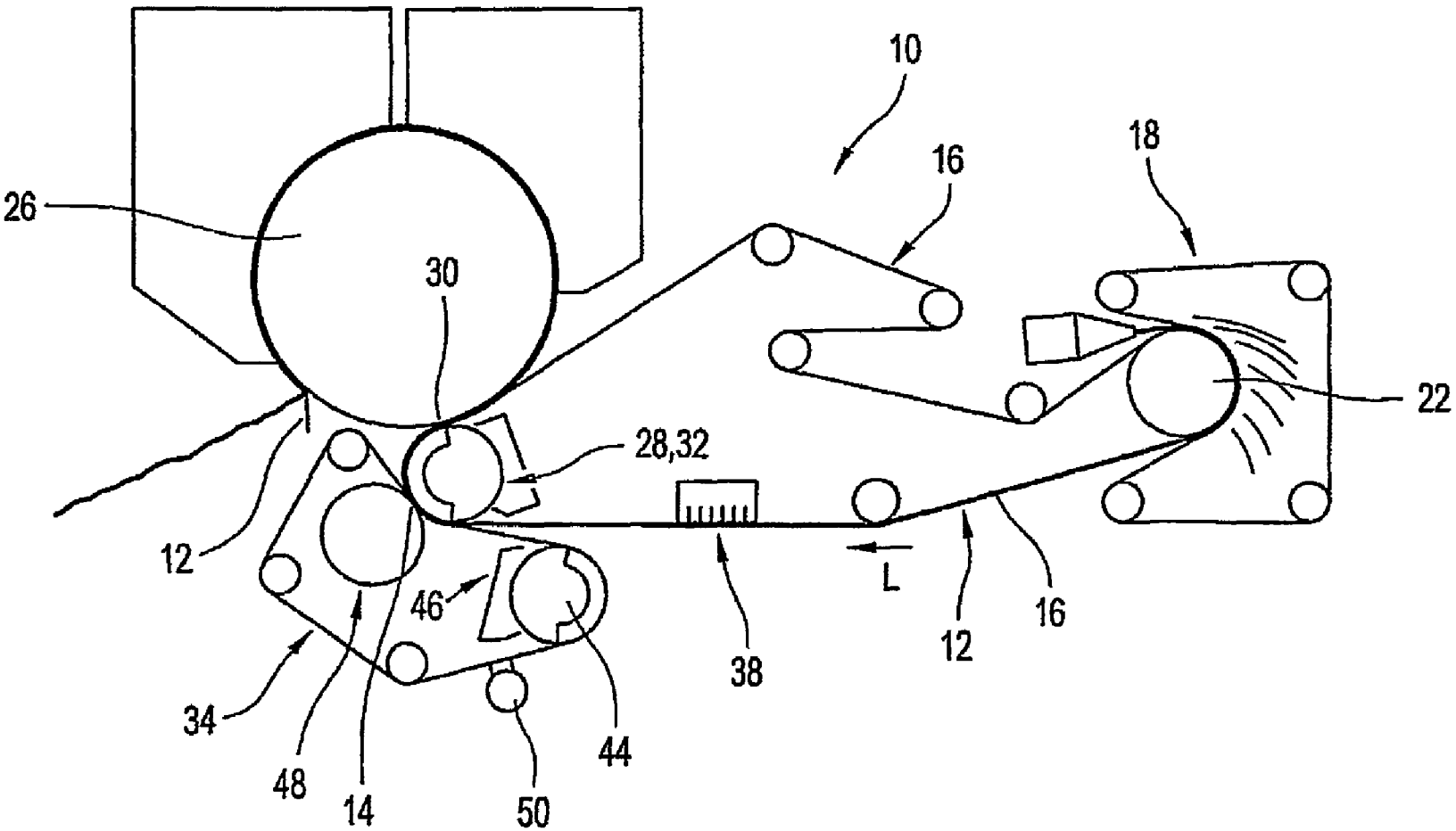
Figure 6:
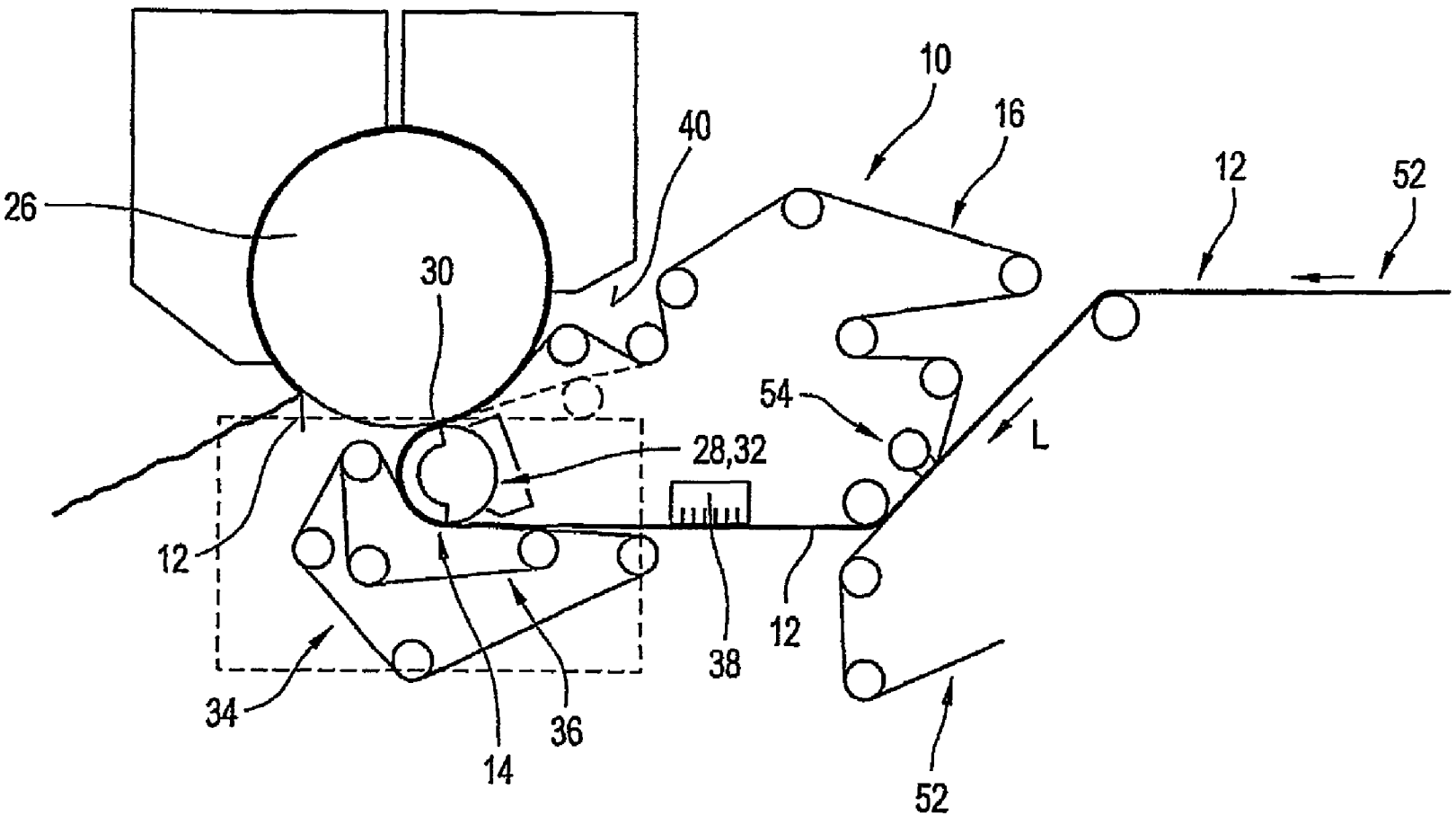
Figure 7:
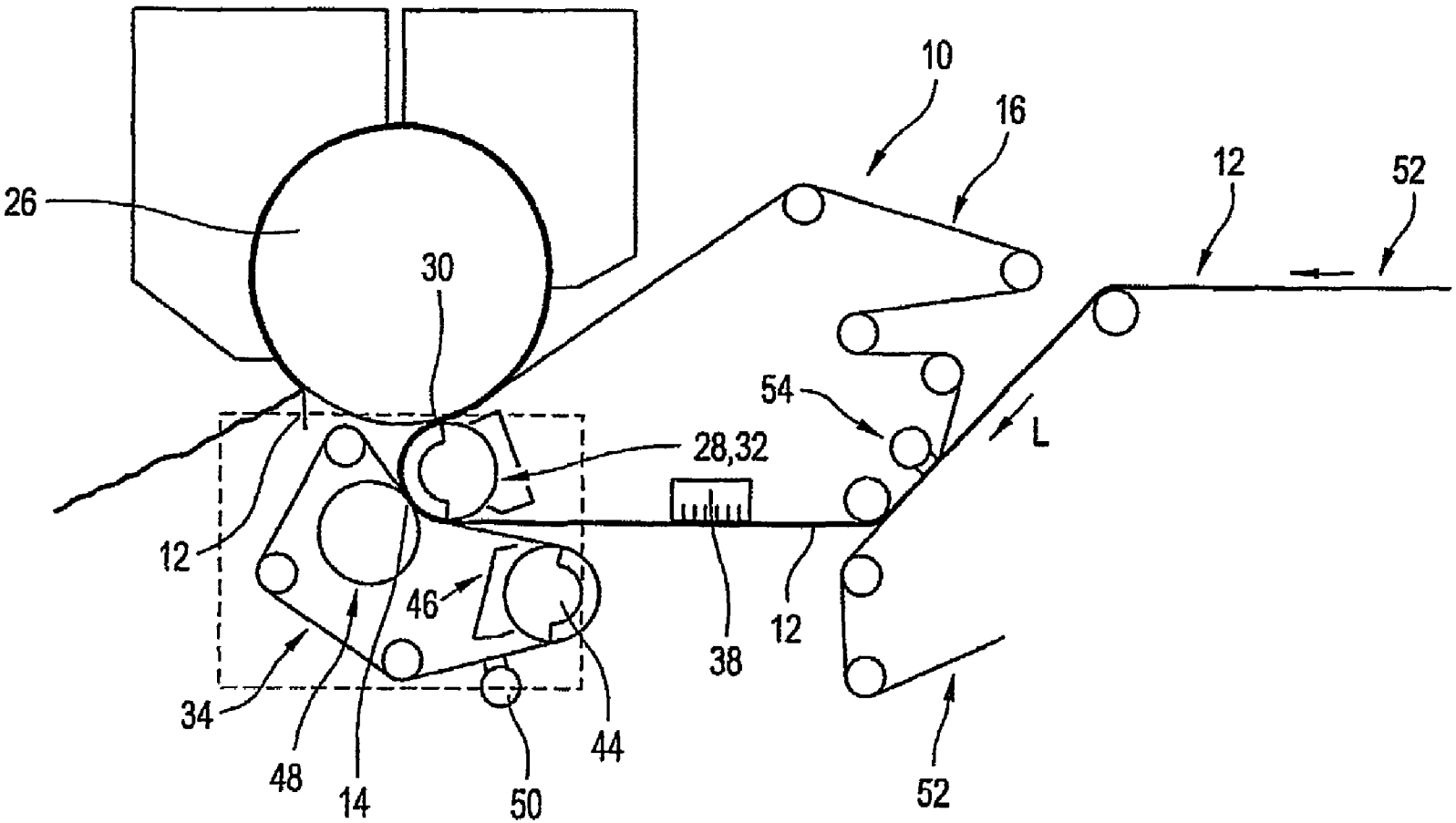

The invention will be explained in the following with reference to embodiments and to the drawings in which are shown:

FIG. 1 a schematic representation of a crescent former having an associated pressing zone combined with a suction system formed here, by way of example, by a belt press;

FIG. 2 a schematic representation of a, for example, horizontal double screen former with an associated pressing zone combined with a suction system which is, for example, again formed here by a belt press;

FIG. 3 a schematic representation of a further embodiment of a crescent former with an associated pressing zone combined with a suction system and, for example, again formed by a belt press, with both the inner belt and also the further dewatering belt being respectively formed by a felt;

FIG. 4 a schematic representation of a further embodiment of a crescent former with an associated pressing zone combined with a suction system which is, for example, formed here by a molding press;

FIG. 5 an embodiment of a crescent former comparable to FIG. 4, with the further dewatering belt being formed by a felt;

FIG. 6 an embodiment of a belt press comparable to FIG. 1 with different formers; and FIG. 7 an embodiment of a molding press comparable to FIG. 5 with different formers.

The formers 10 shown in FIGS. 1 to 5 are each part of a machine for the manufacture of a fiber material web which can in particular be a paper web or a card web. In this connection at least one pressing zone 14 combined with a suction system is provided in each case.

Whereas the pressing zone 14 combined with a suction system is formed in each of the embodiments shown in FIGS. 1 to 3 by a belt press, a molding press is provided in each of the embodiments of FIGS. 4 and 5.

In accordance with FIG. 1, the relevant machine includes a former 10 with two circulating dewatering belts 16, 18 which converge while forming a material inlet gap 20 and are subsequently led as an inner belt and as an outer belt respectively over a forming element formed here by a forming roll 22.

The fiber material suspension is introduced into the material inlet gap 20 by means of a headbox 24.

The pressing zone 14 combined with a suction system is provided in the web running direction L in front of a nip 30 formed between a dryer cylinder 26, preferably a Yankee cylinder, and a counter element 28.

For the formation of the pressing zone 14 combined with a suction system an element 32 to which suction can be applied is provided which, in the present case, is for example a suction roll.

The fiber material web 12 is supplied together with the inner belt 16 which wraps around the forming roll 22 to the pressing zone 14. In this arrangement a further dewatering belt 34 is led around the element 32 to which suction can be applied in addition to the inner belt 16 which is directly supported on it. The fiber material web 12 lies here between the inner belt 16 and the further dewatering belt 34.

In the present embodiment of FIG. 1 a belt 36 is tensioned around the element 32 to which suction can be applied, is arranged within the loop of the further dewatering belt 34 and can be formed by a customary, in particular non-structured screen, or also by a structured screen.

Thus, the further dewatering belt 34 led around the element 32 to which suction can be applied can, for example, be formed by a TAD screen (TAD=Through-Air-Drying) or, for example, by a dewatering screen with differing screen permeability zone-wise, such as in particular a so-called DSP screen.

Screens of the type which are described in PCT/G99/02684 can, for example, be considered as screens with permeability which differs zone-wise. In accordance with therewith, the relevant screens can, in particular, consist of a fabric in which threads extending in a first direction in one plane or in a plurality of planes are interwoven with threads extending in a second direction such that a grid results which separates a plurality of systematically distributed zones of pre-determinable configuration from one another and correspondingly determines them, with the systematically distributed zones each including at least three threads extending in the one direction and at least three threads extending in the other direction. The threads can, in particular, be weft threads and warp threads.

The tension of the belt 36 tensioned around the element 32 to which suction can be applied and arranged within the loop of the further dewatering belt 34 is expediently larger than or equal to 60 kN/m.

The belt 36 tensioned around the element to which suction can be applied and arranged within the loop of the further dewatering belt 34 can have a smooth or closed surface or also a drilled and/or grooved surface.

In the present embodiment in accordance with FIG. 1 the pressing zone 14 combined with a suction system forms a longitudinal gap extended in the web running direction L.

As can be recognized with respect to FIG. 1, the element 32 to which suction can be applied is preferably simultaneously provided as the counter-element 28 which forms the nip 30 together with the dryer cylinder or the Yankee cylinder 26.

The outer belt 18 which wraps around the forming roll 22 is formed by a dewatering screen, with the former 10 being provided in the present case as a crescent former of which the outer belt 18 is formed by the dewatering screen and the inner belt 16 is formed by a felt.

The dry content of the fiber material web 12 in front of the pressing zone 14 preferably lies in a range from about 8% to about 15% and after the pressing zone 14 in a range of about 40% or higher.

A suction box 38 can be provided between the forming element 22 and the pressing zone 14. In this connection, the dry content of the fiber material web 12 directly after the suction box 38 and before the pressing zone 14 preferably lies in a range of about 23%.

Depending on whether a higher priority is associated with the quality or with the productivity, the fiber material web 12 can be supplied to the dryer cylinder or to the Yankee cylinder 26 with an open nip or closed nip 30. As can be seen with respect to FIG. 1, a preferably adjustable guide roll 40 for the inner belt 16 which guides the fiber material web 12 with it is provided in the web running direction L after the nip 30.

The tension of the further dewatering belt 34 can in particular amount to about 5 kN/m. The tension of the outer belt 18 amounts preferably to about 8 kN/m. The tension of the inner belt 16 can in particular amount to about 5 kN/m.

In the present embodiment of FIG. 1 a crescent former 10 is thus provided with a dewatering belt or dewatering screen as an outer belt 18 and a felt as an inner belt. However, as already mentioned, the fiber material web 12 can be formed in the context of the present invention with all types of formers. When the fiber material web 12 approaches the pressing zone 14, then it is to be arranged in the present case beneath the inner belt 16 which is formed here by a felt. The dry content of the fiber material web in front of the pressing zone 14 expediently lies in a range of about 8% to about 15% and after the pressing zone 14 preferably in a range of about 40% or higher.

So far as necessary, a suction box 38 can also be used which helps the press to dry the inner belt 16 formed by the felt and the fiber material web 12 in order to provide additional space within the felt and thus to absorb more water from the structure of the fiber material web 12. In this case the dry content of the fiber material web 12 directly after the suction box 38 and in front of the pressing zone 14 preferably lies in a range of about 23%.

The belt press provided here operates as follows:

The fiber material web 12 is basically enclosed in sandwich-like manner between a further dewatering belt 34 formed in particular by a screen and the inner belt 16 which is directly supported on the surface of the element to which suction can be applied, or on the suction roll which supports the inner belt 16. In this arrangement the further dewatering belt 34 can be a conventional, in particular non-structured screen or also a structured screen. Thus, by way of example, as already mentioned, a TAD screen, a dewatering screen with differing screen permeability zone-wise, such as in particular a so-called DSP screen or the like can be provided.

Within the loop of the further dewatering belt 34 a belt 36 (fabric or belt) is arranged which is tensioned at a high tension of preferably about 60 kN/m or more and which thus generates a distributed load over the element 32 to which suction can be applied, which is, for example, formed here by a suction roll. The strongly tensioned belt 36, which is, for example, a fabric belt or can be another belt (fabric or belt), can have a smooth or closed surface or also a drilled and/or grooved surface. As a result of the specific extension of the pressing zone 14 the maximum pressing pressure and a specific pressure within this pressing zone 14 which is extended in the web running direction L is very low, i.e. approximately 40 times lower than in a customary suction press, so that paper of high quality is produced having regard to the so-called bulk or volume.

For the transfer of the fiber material web 12 onto the surface of the dryer cylinder or Yankee cylinder 26 there are fundamentally two basic possibilities: If quality stands at the forefront, then the nip 30 formed between the element 32 to which suction can be applied, and which is preferably formed here by a suction roll, and the dryer cylinder or Yankee cylinder 26 can remain open. The fiber material web 12 is only transferred in that attention is paid to a specific wrapping angle of the inner belt formed here by a felt around the dryer cylinder or Yankee cylinder 26. In this arrangement one can proceed in such a way that the guide roll 40 for the inner belt 16 is correspondingly moved or adjusted directly after the drier cylinder or the Yankee cylinder. If, in contrast, productivity stands in the forefront, then the nip 30 is closed and in this case the fiber material web 12 is dried to a much greater degree in conjunction with an increase of the production.

A further advantage of this arrangement lies in the fact that a pressing zone 14 is provided which is combined with a suction system. In the event of a shoe pressing unit is associated with the drier cylinder or Yankee cylinder 26 only pressure is generated. With a suction roll associated with the dryer cylinder or the Yankee cylinder 26 the surface of the dryer cylinder or Yankee cylinder 26 does not permit any air flow through the nip 30 despite the presence of vacuum.

This is the only press which simultaneously enables an air flow through the nip 30 during pressing. As a consequence, one obtains after the press an additional gain in dry content.

As indicated at "42" the suction in the region of the element 32 can in particular take place at least substantially over the entire machine width.

In the embodiment of FIG. 2 a double screen former is provided as the former 10, with the inner belt 16 which wraps around the forming elements and the forming roll 22 being formed by a conventional or structured dewatering belt or screen instead of by a felt. The tension of this dewatering belt 16 expediently amounts again to about 5 kN/m.

One can in particular term the suction box 38 here also as a "wet shaping box". It removes some water from the paper and simultaneously produces cushions on the sheet structure. In this case the dry content of the paper lies directly after the wet shaping box and prior to the pressing step preferably at about 20%. After the press a dry content of about 40% is expected.

The further dewatering belt 34 is formed in the present case by a felt, the tension of which expediently amounts again to about 5 kN/m.

Within the loop of the further dewatering belt 34 or felt a further element 44 to which suction can be applied is provided for the drying of the further dewatering belt or felt 34. As can be seen with reference to FIG. 2, this further element 44 to which suction can be applied is only wrapped around by the further dewatering belt 34 or felt. This further element 44 to which suction can be applied can in particular also be a suction roll or suction box. As indicated at 46 a suction over at least substantially the full machine width can in particular also take place again here.

In the present case, the transfer of the fiber material web 12 to the dryer cylinder or Yankee cylinder 26 takes place simply by closing of the nip 30. In this case the sheet structure is not destroyed since the pressing takes place using a dewatering belt or screen (wire) through which only a part of the sheet is pressed.

In other respects, this embodiment in accordance with FIG. 2 can in particular have at least substantially the same construction again as the embodiment of FIG. 1. The same reference numerals are associated with parts which correspond to one another.

In the embodiment of FIG. 3 a crescent former with a dewatering belt or dewatering screen as an outer belt and a felt as an inner belt 16 is again provided as the former 10.

In the present case not only the inner belt 16, but also the further dewatering belt 34 is formed by a felt. In the region of the pressing zone 14 combined with a suction system the fiber material web 12 thus lies in sandwich-like manner between two felts.

An adjustable guide roll 40 for the inner belt 16 can in particular also be provided again.

In other respects, this embodiment in accordance with FIG. 3 has in particular at least substantially the same construction again as that of FIG. 2. The same reference numerals are associated with parts which correspond to one another.

In the embodiment of FIG. 4 the former 10 is again provided as a crescent former with a dewatering belt or dewatering screen as the outer belt and a felt as the inner belt 16. The associated pressing zone 14 combined with a suction system is for example formed here by a molding press.

As can be seen with respect to FIG. 4, a roll 48 is arranged for this purpose within the loop of the further dewatering belt 34 opposite to the element 32 to which suction can be applied. This roll can have a closed surface or can also be grooved and/or blind-drilled. In the present case it is for example formed by a rigid roll. However, a shoe pressing unit can, for example, also basically be provided instead of such a rigid roll 48. Basically, both a normal gap or a longitudinal gap can also be formed. The shoe pressing unit can, for example, be a shoe pressing roll.

As a result of the further dewatering belt or screen 34 in the pressing zone 14 the sheet surface is not fully pressed whereby paper of high quality is obtained.

In other respects this embodiment in accordance with FIG. 4 can in particular again have at least substantially the same construction as that of FIG. 1. The same reference numerals are associated with parts which correspond to one another.

In the embodiment of FIG. 5 a horizontal double screen former with a dewatering screen as the outer belt 18 and a structured or non-structured dewatering belt or screen as the inner belt 16 is again provided as the former 10. The pressing zone 14 combined with a suction system is also, for example, again formed in the present case by a molding press.

Within the loop of the dewatering belt 34 or felt a further element 44 to which suction can be applied can be provided for the drying of the dewatering belt or felt 34. As can be seen with reference to FIG. 5, this further element 44 to which suction can be applied is only wrapped around by the dewatering belt 34 or felt. This further element 44 to which suction can be applied can in particular also be a suction roll or suction box. As indicated at 46 a suction over at least substantially the full machine width can in particular also take place again here. Furthermore, a vacuum box 50 or the like can be associated with the dewatering belt or felt 34.

In other respects the present embodiment of FIG. 5 is distinguished from that of FIG. 4 essentially only in that the further dewatering belt 34 is formed by a felt. The same reference numerals are associated with parts which correspond to one another.

FIG. 6 shows an embodiment of a belt press comparable to FIG. 1 with different formers. For example, all kinds of tissue formers like the following examples can be provided: Duoformer T, Twin wire former, C-wrap former, S-wrap former, Foudrinier, Suction breast roll former, etc.

In FIG. 6, only a wire 52 of the respective former is shown. The fiber material or paper web 12 is passed from this wire 52 to the felt 16 in the region of a pick-up tube or roll 54.

In other respects, the present embodiment of FIG. 6 is comparable to FIG. 1. The same reference numerals are associated with parts which correspond to one another.

FIG. 7 shows an embodiment of a molding press comparable to FIG. 5 with different formers. For example, all kinds of tissue formers like the following examples can be provided: Duoformer T, Twin wire former, C-wrap former, S-wrap former, Foudrinier, Suction breast roil former, etc.

In FIG. 7, only a wire 52 of the respective former is shown. The fiber material or paper web 12 is passed from this wire 52 to the felt 16 in the region of a pick-up tube or roll 54.

In other respects, the present embodiment of FIG. 7 is comparable to FIG. 5. The same reference numerals are associated with parts which correspond to one another.

REFERENCE NUMERAL LIST

10 former
12 fiber material web
14 pressing zone
16 dewatering belt, inner belt, felt
18 dewatering belt, outer belt
20 headbox
22 forming element, forming roll
24 head box
26 dryer cylinder, Yankee cylinder
28 counter-element
30 nip
32 element to which suction can be applied
34 further dewatering belt
36 belt arranged within the loop of the further dewatering belt
38 suction box
40 guide roll
42 suction over the width
44 further element to which suction can be applied
46 suction over the width
48 roll
50 vacuum box
52 wire
54 pick-up tube or roll
L web running direction

The invention claimed is:

1. A machine that manufactures a fiber material web, comprising:

a forming region, the forming region having at least one circulating, endless, dewatering belt including an inner belt;

at least one pressing zone combined with a suction system, an element to which suction can be applied forming the at least one pressing zone combined with the suction system;

an additional dewatering belt, the additional dewatering belt being guided around the element, the fiber material web being between the inner belt and the additional dewatering belt; and at least one of:

(a) a belt, the belt being arranged within a loop of the additional dewatering belt, the belt being tensioned around the element; and (b) a roll that lies opposite to the element to which suction can be applied within a loop of the additional dewatering belt.

2. The machine of claim 1, further comprising a former having two circulating, endless, dewatering belts, wherein the dewatering belts converge while forming a material inlet gap, and wherein the dewatering belts are subsequently led as the inner belt and an outer belt over a forming element.

3. The machine of claim 2, wherein the forming element is a forming roll.

4. The machine of claim 2, wherein the fiber material web is led to the pressing zone with the inner belt.

5. The machine of claim 2, wherein the outer belt is formed by a dewatering screen.

6. The machine of claim 5, wherein the former is a crescent former and the inner belt is formed by a felt.

7. The machine of claim 2 further comprising a suction box, wherein the suction box is between the forming element and the pressing zone.

8. The machine of claim 7, wherein dry content of the fiber material web directly after the suction box and before the pressing zone has a range of approximately 23%.

9. The machine of claim 2, wherein the outer belt has a tension of approximately 8 kN/m.

10. The machine of claim 2, wherein the inner belt has a tension of approximately 5 kN/m.

11. The machine of claim 2, wherein the former is a double screen former.

12. The machine of claim 1, wherein the pressing zone combined with the suction system is in the web running direction in front of a nip, the nip formed between one of a dryer cylinder and a Yankee cylinder, and a counter element.

13. The machine of claim 12, further comprising a guide roll for the inner belt that moves the fiber material web, wherein the guide roll is in the running direction after the nip, and wherein the guide roll is one of an adjustable guide roll and a non-adjustable guide roll.

14. The machine of claim 12, wherein the fiber material web is supplied to one of the dryer cylinder and the Yankee cylinder by closing of the nip.

15. The machine of claim 1, wherein the element includes a suction roll.

16. The machine of claim 1, wherein the additional dewatering belt is a non-structured screen.

17. The machine of claim 1, wherein the additional dewatering belt is a structured screen.

18. The machine of claim 1, wherein the additional dewatering belt is a TAD screen.

19. The machine of claim 1, wherein the additional dewatering belt is a dewatering screen having a differing screen permeability zone-wise.

20. The machine of claim 1, wherein the tension of the belt is greater than or equal to 60 kN/m.

21. The machine of claim 1, wherein the belt has a smooth surface.

22. The machine of claim 1, wherein the belt has at least one of a drilled surface and a smooth surface.

23. The machine of claim 1, wherein the pressing zone combined with a suction system forms a longitudinal gap.

24. The machine of claim 1, wherein the element is also a counter element that forms a nip with one of a dryer cylinder and a Yankee cylinder.

25. The machine of claim 24, wherein the fiber material web is supplied with the nip at least one of open and closed.

26. The machine of claim 1, wherein dry content of the fiber material web has a range of approximately 8% to approximately 15% before the pressing zone and wherein the dry content of the fiber material web is approximately 40% or greater after the pressing zone.

27. The machine of claim 1, wherein the additional dewatering belt has a tension of approximately 5 kN/m.

28. The machine of claim 1, further comprising a second element to which suction can be applied, the second element provided within a loop of the additional dewatering belt.

29. The machine of claim 28, wherein the second element is only wrapped around by the additional dewatering belt.

30. The machine of claim 28, wherein the second element is formed by one of a suction roll and a suction box.

31. The machine of claim 1, wherein the inner belt and the additional dewatering belt are each formed by a felt.

32. The machine of claim 1, wherein the roll is at least one of a closed surface, grooved and blind drilled.

33. The machine of claim 1, wherein the roll is a rigid roll.

34. The machine of claim 1, further comprising a shoe pressing unit that lies opposite to the element to which suction can be applied within a loop of the additional dewatering belt.

35. The machine of claim 34, wherein the shoe pressing unit further comprises a shoe pressing roll.

36. The machine of claim 1, wherein the former is a double screen former and wherein the additional dewatering belt is formed by a felt.

* * * * *